US010669094B1

(12) United States Patent
Mulder

(10) Patent No.: US 10,669,094 B1
(45) Date of Patent: Jun. 2, 2020

(54) ADJUSTABLE HEATED GAS-GUIDING SYSTEM

(71) Applicant: Joshua Mulder, Sioux Falls, SD (US)

(72) Inventor: Joshua Mulder, Sioux Falls, SD (US)

( * ) Notice: Subject to any disclaimer, the term of this patent is extended or adjusted under 35 U.S.C. 154(b) by 0 days.

(21) Appl. No.: 16/049,234

(22) Filed: Jul. 30, 2018

(51) Int. Cl.
*B65D 88/74* (2006.01)

(52) U.S. Cl.
CPC ..... *B65D 88/744* (2013.01)

(58) Field of Classification Search
CPC .... B65D 88/744; B65D 88/748; B65D 88/74; A47J 36/36; A47J 37/0786; F24C 1/16; F24B 1/205
USPC ..... 220/577
See application file for complete search history.

(56) References Cited

U.S. PATENT DOCUMENTS

| | | | | |
|---|---|---|---|---|
| 835,715 | A | 11/1906 | Sesseli | |
| 881,199 | A | 3/1908 | Palmer | |
| 1,431,696 | A | 10/1922 | Shankland | |
| 1,471,788 | A | 10/1923 | Gardner | |
| 1,592,729 | A | 7/1926 | Feist | |
| 1,881,606 | A | 10/1932 | Humphreville | |
| 2,541,265 | A * | 2/1951 | McGregor | A47J 36/36 126/215 |
| 3,002,822 | A | 10/1961 | Leslie | |
| 5,682,872 | A * | 11/1997 | Whitted | F24C 1/16 110/241 |
| 6,425,387 | B1 * | 7/2002 | Rohback, Jr. | F24B 1/205 126/152 A |
| 7,694,671 | B2 | 4/2010 | Lee | |
| D658,438 | S | 5/2012 | Zandbergen | |
| 8,360,049 | B2 * | 1/2013 | Stephens | E04H 15/003 126/30 |
| 9,138,098 | B1 | 9/2015 | Sun | |
| 2006/0243271 | A1 | 11/2006 | Peacock | |
| 2007/0039603 | A1 | 2/2007 | Lindsly | |
| 2012/0167778 | A1 | 7/2012 | Popeil | |

* cited by examiner

*Primary Examiner* — Anthony D Stashick
*Assistant Examiner* — L Kmet
(74) *Attorney, Agent, or Firm* — Jeffrey A. Proehl; Woods, Fuller, Shultz & Smith, PC

(57) ABSTRACT

A shield assembly forms a loop for guiding heated gases from a heat source along a peripheral wall of the container and may include a plurality of guide panels collectively in an array of connected guide panels. The guide panels may be pivotally connected to adjacent guide panels to pivot with respect to each other to pivot with respect to each other. The guide panels may have a base plate with an inner surface for orienting toward the container, and may also have at least one vane extending inwardly from the base plate to a free end of the vane positionable adjacent to the peripheral wall of the container. The vane may be positioned at an oblique angle to the pivot axis. The shield assembly may also include a linking structure configured to link endmost guide panels of the array of connected guide panels.

15 Claims, 9 Drawing Sheets

ADJUSTABLE HEATED GAS-GUIDING SYSTEM

BACKGROUND

Field

The present disclosure relates to heated gas guides and more particularly pertains to a new adjustable heated gas-guiding system for facilitating heat transfer to a container.

SUMMARY

The present disclosure relates to a shield assembly forming a loop positionable about a container to guide heated gases from a heat source along a peripheral wall of the container. The shield assembly may comprise a plurality of guide panels collectively in an array of connected guide panels forming at least a portion of the loop, with the guide panels being pivotally connected to adjacent guide panels to pivot with respect to each other such that the guide panels are pivotable with respect to each other about a pivot axis. Each of the guide panels may comprise a base plate having an inner surface for orienting toward the container and an outer surface for orienting away from the container, and at least one vane extending inwardly from the base plate to a free end of the vane positionable adjacent to the peripheral wall of the container. The vane may be positioned at an oblique angle to the pivot axis. The shield assembly may also include a linking structure configured to link endmost guide panels of the array of connected guide panels.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
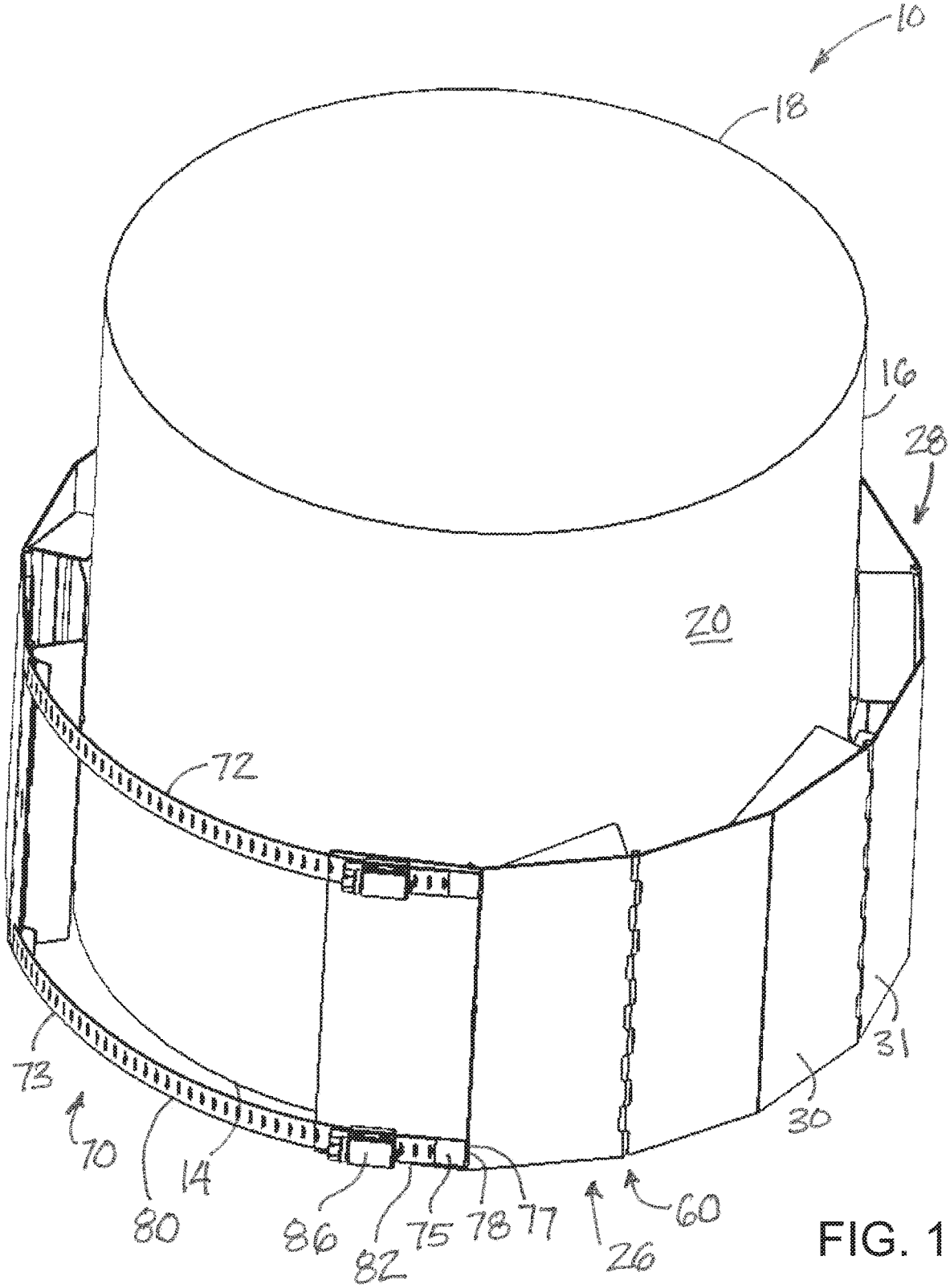
FIG. 1 is a schematic perspective view of a new adjustable heated gas-guiding system according to the present disclosure.
Figure 2:
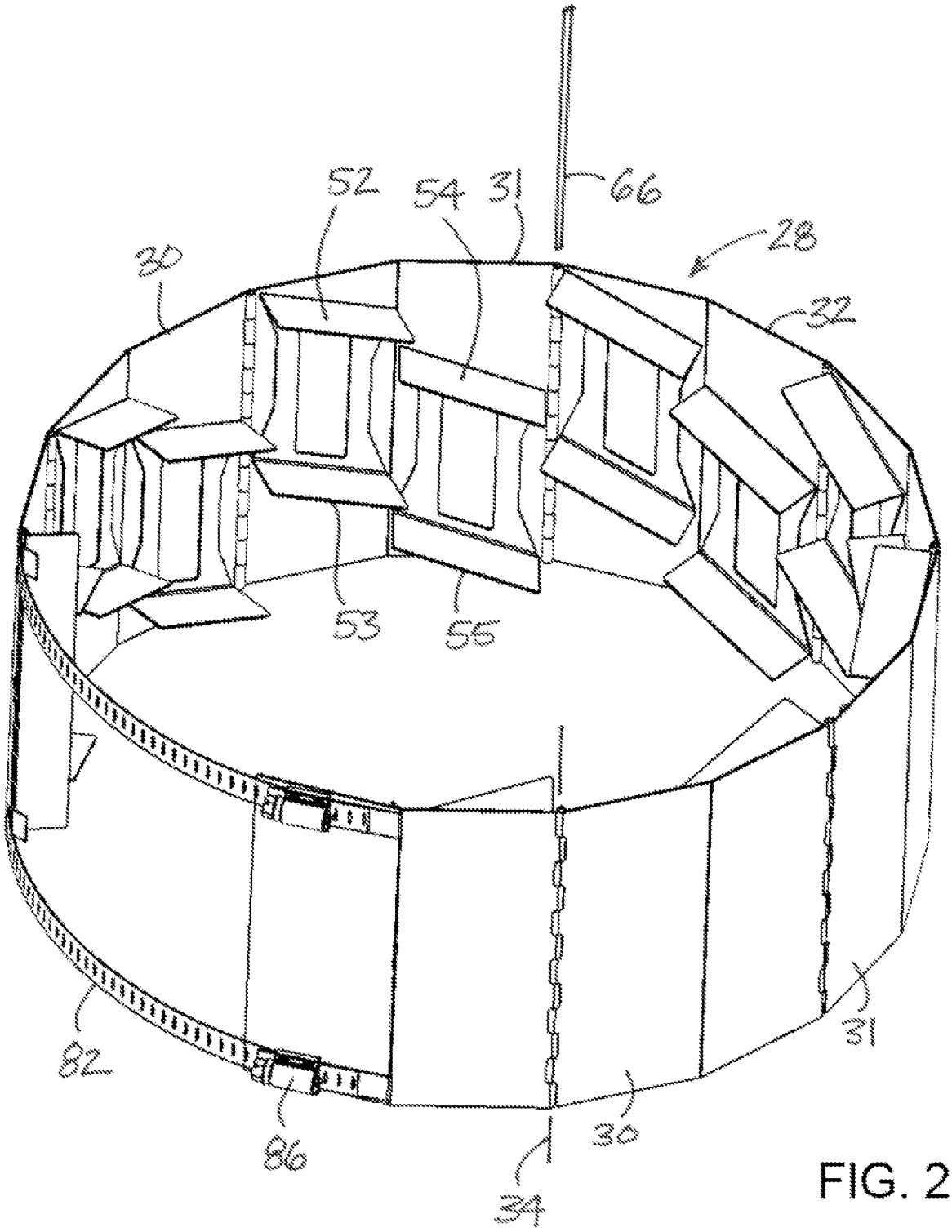
FIG. 2 is a schematic perspective view of the shield assembly of the system, according to an illustrative embodiment.
Figure 3:
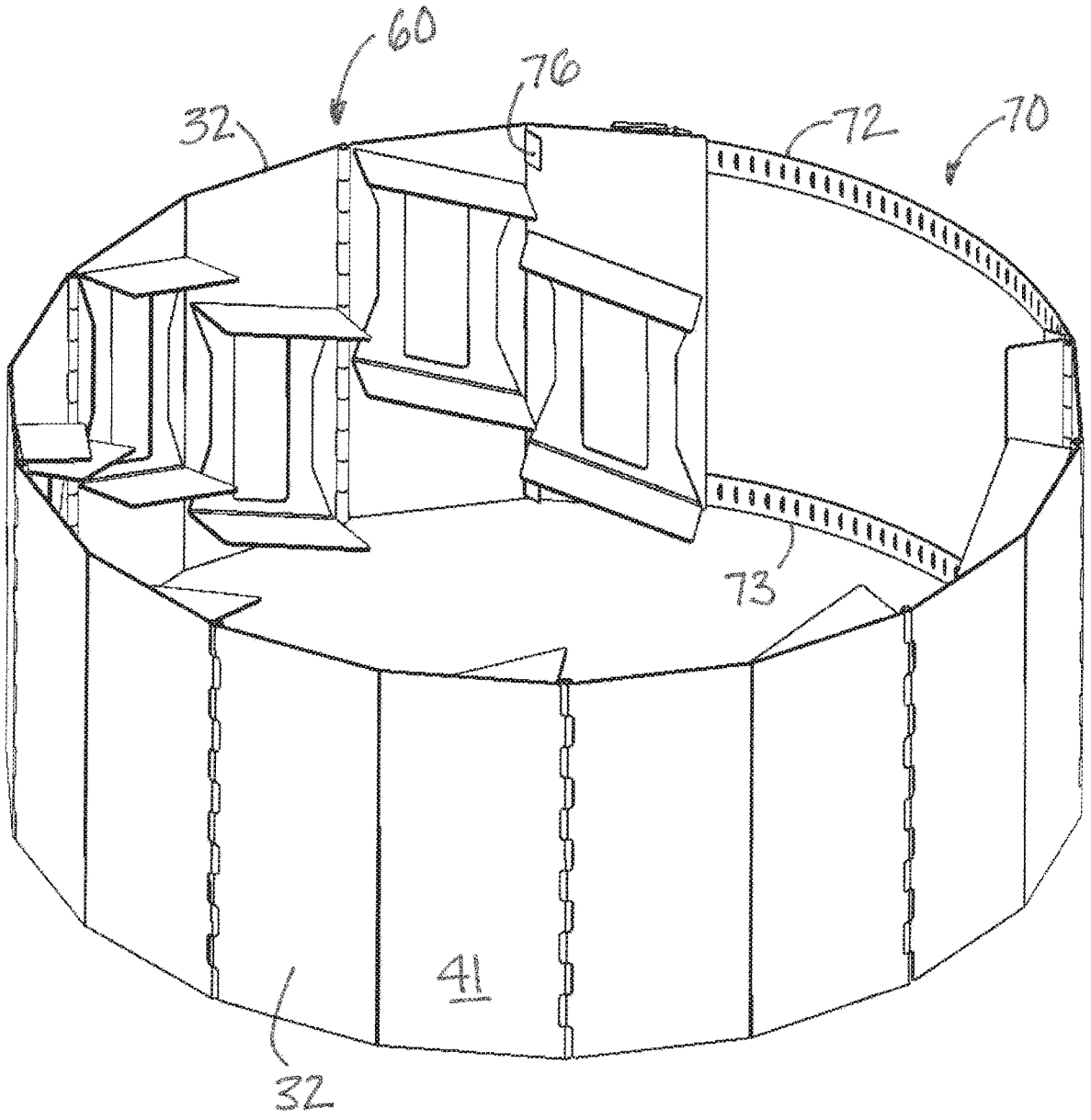
FIG. 3 is a schematic perspective view of the shield assembly of the system taken from another perspective point, according to an illustrative embodiment.
Figure 4:
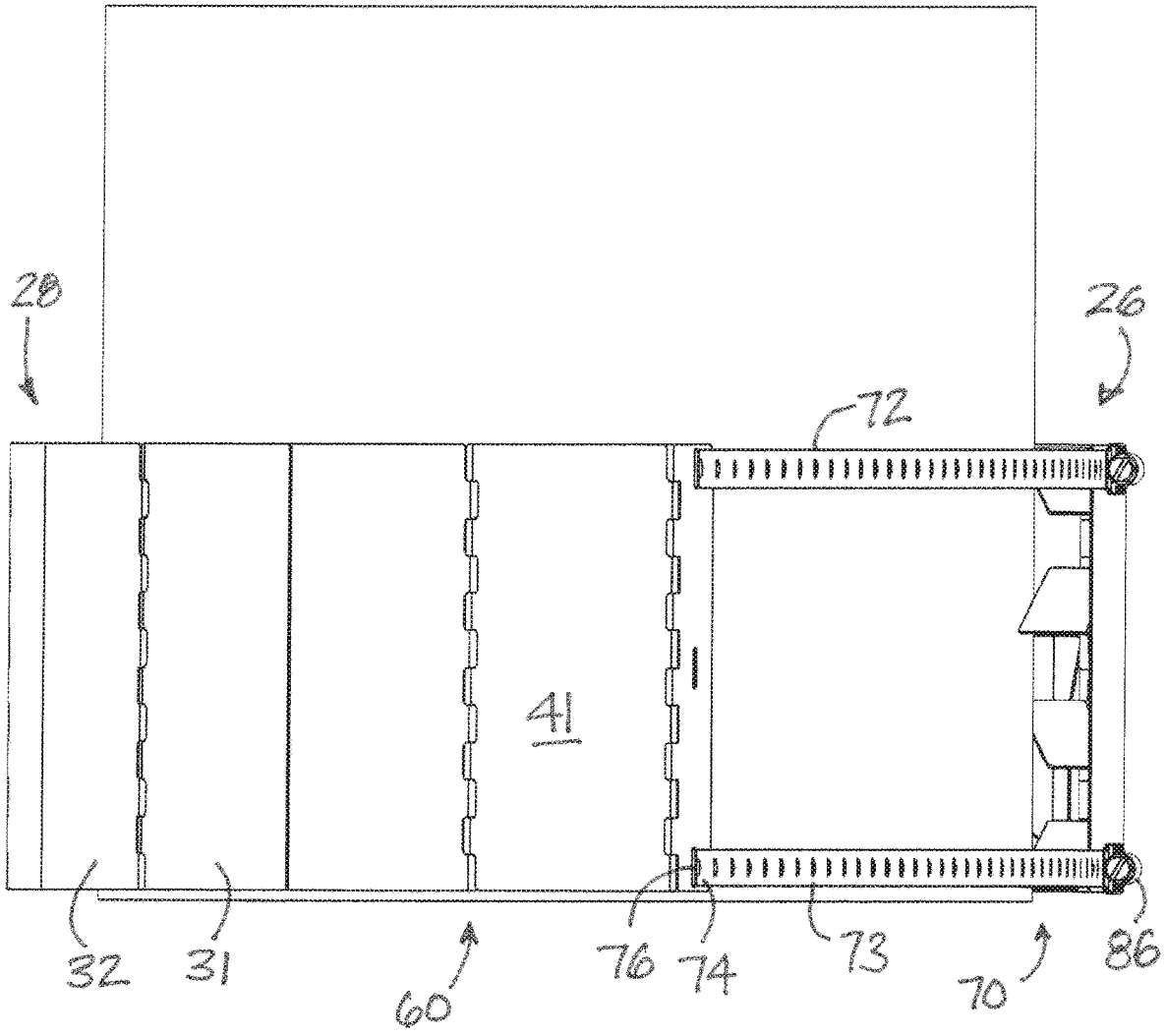
FIG. 4 is a schematic side view of the shield assembly according to an illustrative embodiment.
Figure 5:
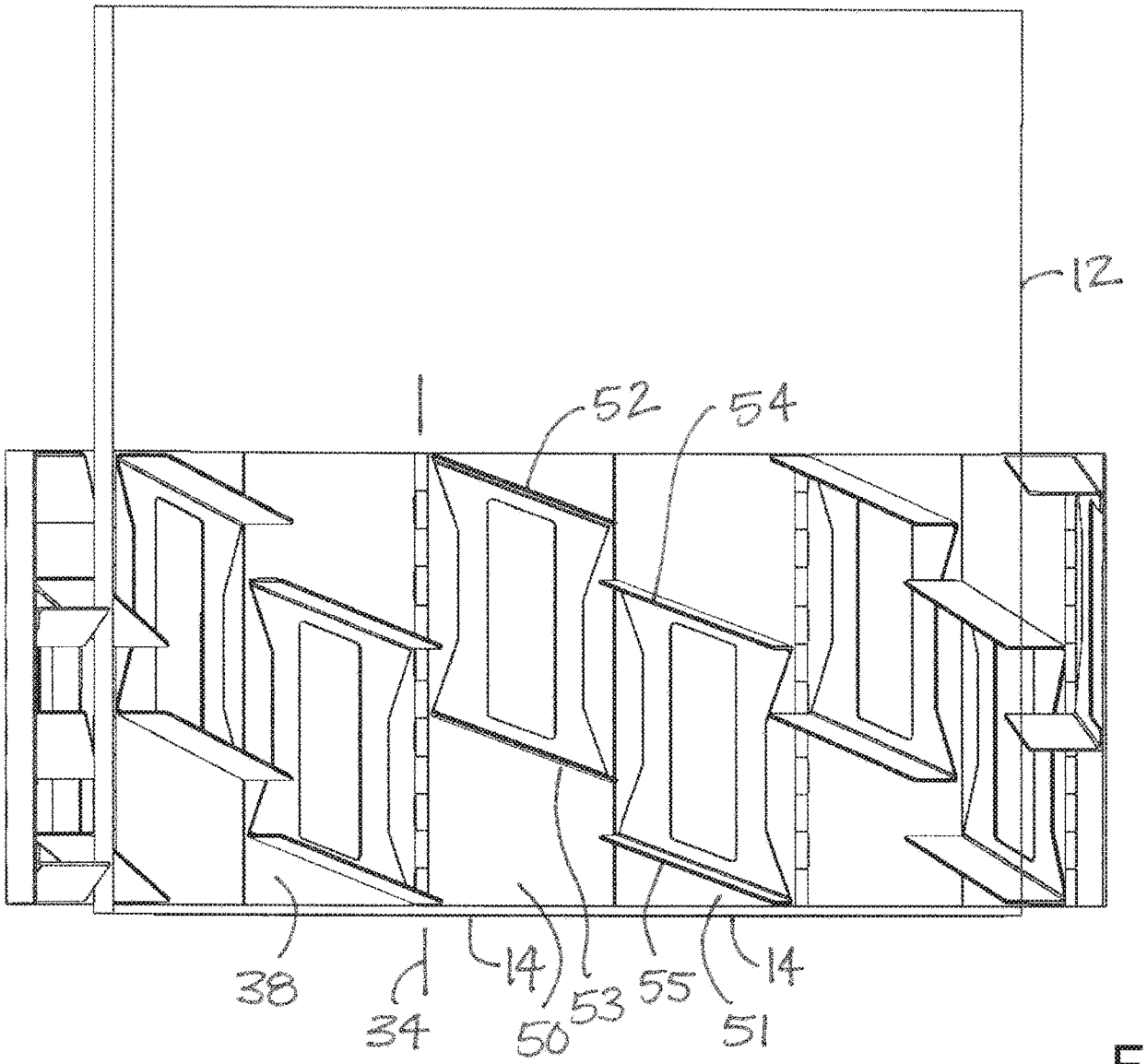
FIG. 5 is a schematic side sectional view of the shield assembly with a phantom outline of the container, according to an illustrative embodiment.
Figure 6:
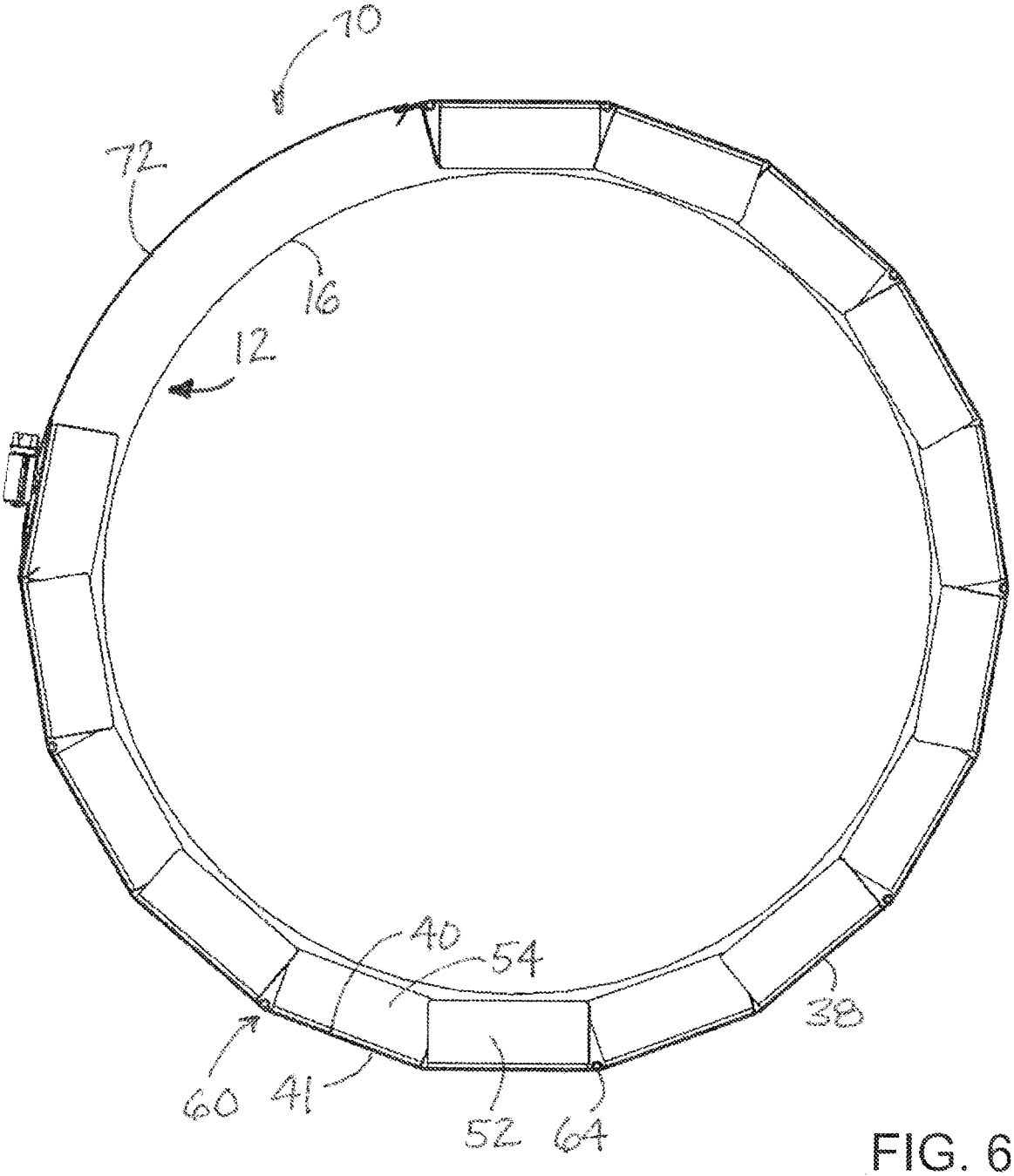
FIG. 6 is a schematic top view of the shield assembly and the container, according to an illustrative embodiment.

With reference now to the drawings, and in particular to FIGS. 1 through 9 thereof, a new adjustable heated gas-guiding system embodying the principles and concepts of the disclosed subject matter will be described.

The applicant has recognized that systems for heating the contents of a container tend to be most efficient when the heated gases generated by the heat source tend to flow adjacent to the surface of the container as much as possible to enhance the convection heating of the container, and in turn the container contents. The applicant has also recognized that the conventional shape of a container with a flat bottom may tend to cause the heated gases contacting the flat bottom surface to move generally horizontally outwardly from the bottom in a flow that does not necessarily closely follow the sides of the container, which typically extend substantially perpendicular to the flat bottom. This divergence of the flow of heated gases from the sides of the container limits the heating of the container and contents by the heat source, resulting in less heating of the container contents and potentially greater consumption of fuel.

The applicant has devised a system and an assembly which helps to guide the heated gases along at least a portion of the sides of the container to enhance the transfer of heat from the gases to the container, and thereby the contents of the container, such as a liquid, in a more efficient manner. Moreover, the assembly may extend the path along which the heated gases travel across the surfaces of the container to further enhance heat transfer.

In one aspect, the disclosure relates to a system 10 which may include a container 12 having a bottom wall 14 and a peripheral wall 16 which extends upwardly from the bottom wall to an upper opening 18 through which the interior of the container is accessed. The peripheral wall 16 may have an outside surface 20 which is typically but not necessarily cylindrical in shape. The system 10 may also include a heat source 22 which is positionable below the container such that heated gases rising from the heat source contact the bottom wall 14. Illustratively, and in some embodiments preferably, the heat source 22 comprises a burner which is configured to burn a combustible fuel to generate the heated combustion gases.

In another aspect, the disclosure relates to a shield assembly 26 alone or in combination with other elements of the system 10. The shield assembly may be configured to guide heat or heated gases rising from the heat source along a portion of the peripheral wall 16 of the container to facilitate contact and heat transfer from the gases to the outside surface 20 of the container. The shield assembly 26 may form a loop 28 for positioning about the container 12, and, in at least some embodiments, the circumference of the loop 28 is adjustable to conform to containers having different peripheral wall sizes and configurations.

In greater detail, the shield assembly may include a plurality of guide panels 30, 31 for positioning about the container to collectively form a perimeter wall 32 about at least a portion of the container to help guide heated gases from the heat source and thereby help concentrate heat from the heat source on the container. The plurality of guide panels 30, 31 may be positionable in an array of connected guide panels, and in some embodiments the array of guide panels may form a substantially cylindrical configuration while in other embodiments the array of guide panels could form a cubic configuration. The array of connected guide panels may form at least a portion of the loop 28 about the container. Each of the guide panels may be pivotally connected to at least one adjacent guide panel in the array to be able to pivot with respect to each other about a pivot axis 34.

Illustratively, each of the guide panels may comprise a base plate 38 which may has an inner surface 40 for orienting toward the container 12 and an outer surface 41 for orienting away from the container. The base plate 38 of adjacent guide panels in the array may form the perimeter wall 32 of the shield assembly. The base plate 38 may have an upper edge 44 and the lower edge 45, and opposite side edges 46, 47 extending between the upper 44 and lower 45 edges. The base plate may have a base axis 48 which extends from the lower edge to the upper edge and may be oriented substantially parallel to the side edges. The base axis 48 may be positioned substantially equidistant between the opposite side edges 46, 47. In some embodiments, the base axis may divide the base plate into two plate portions 50, 51, and the inner surfaces 40 of the plate portions may be oriented in planes that are oblique to each other such that the inner surfaces of the plate portions form a convex collective surface. During use of the shield assembly, the base axis may be substantially vertically oriented.

Each guide panel may also include at least one vane 52 for guiding gas flow passing between the base plate and a container positioned within the loop 28. The vein 52 may extend from the base plate 38 inwardly from the plate toward the container when the shield assembly is positioned about the container. The vane 52 may extend inwardly from the inner surface 40 of the base plate and terminate at a free end. In some embodiments, a pair of vanes 52, 53 may be positioned on the base plate, and may be positioned on one of the plate portions 50, 51 of the plate with a first one of the vanes being located relatively closer to the upper edge of the base plate and a second one of the vanes being located relatively closer to the lower edge. In the illustrative embodiments, some of the guide panels may have two pairs of vanes 52, 53, 54 and 55. Optionally, the pair of vanes on a guide panel may be formed by a piece of sheet material attached to the inner surface of the plate with sections of the piece being bent outwardly away from the inner surface in a substantially perpendicular relationship to the inner surface. Other suitable structures for forming the vanes may also be employed.

Each of the vanes 52 may be positioned in a plane that is oriented at an oblique angle to the base axis 48, and may be oblique to the pivot axis 34 as well. The vanes may be oriented at similar or identical oblique angles to produce a flow direction in heated gases passing between the vanes that tends to swirl in a helix about the outside surface of the container. Thus, a first vane on one plate portion may be positioned slightly higher on the plate than a first vane on the other plate portion, and to some degree the first vane on one plate portion may form an upward continuation of the first vane on the other plate portion. The patterns of position and orientation of the vanes may be duplicated on many or all of the guide panels forming the loop.

The shield assembly 26 may also include a hinge structure 60 which connects adjacent guide panels of the array together, and generally permits a degree of pivotal movement of the panels with respect to each other. Illustratively, the hinge structure 60 may include hinge tabs 62, 63 formed on adjacent guide panels, and the hinge tabs may be located on the guide panels so that they may be positioned in an alternating and optionally interlocked manner which permits pivot movement of the plates with respect to each other. The hinge tabs may form a pin passage 64 which extends along the pivot axis for the corresponding base plate. A hinge pin 66 may engage the hinge tabs 62, 63 of the adjacent guide panels to connect the guide panels together in a pivotal manner. The hinge pin 66 may pass through the pin passages 64 of the hinge tabs of the adjacent guide panels.

Further, the shield assembly 26 may include a linking structure 70 which is configured to link the endmost guide panels of the array of connected guide panels together in an adjustable manner permitting adjustment of the size of the gap between the endmost guide panels to thereby permit adjustment of the effective circumferential length of the loop 28 to a size suitable for various sizes of containers.

An exemplary linking structure 70 may include at least one link 72 which spans between the endmost guide panels and which has opposite end portions 74, 75 that each engage one of the endmost guide panels. Illustratively, each of the end portions 74, 75 of the link may be formed into a hook 76, 77, and each of the endmost guide panels may have a hook aperture 78 formed therein to be engaged by one of the hooks. In the illustrative embodiment, a pair of links 72, 73 are employed and are spaced from each other in a substantially vertical direction and each of the links engages each of the endmost guide panels via respective hooks and hook apertures. Each of the links 72, 73 may include two link portions 80, 82 and each of the link portions may have one of the end portions 74, 75 and the hook 78 formed on the end portion. The linking structure 70 may further include a length adjustment element 86 which is configured to adjust an effective length of the link to thereby adjust a distance between the endmost guide panels to which the link is connected. The length adjustment element 86 may engage each of the link portions of the length at an adjustable location on the link portion to thereby adjust the effective length of the link. Illustratively, the links and length adjustment element may be formed of components typically utilized in a worm gear clamp, sometimes referred to as a hose clamp.

Figure 7:
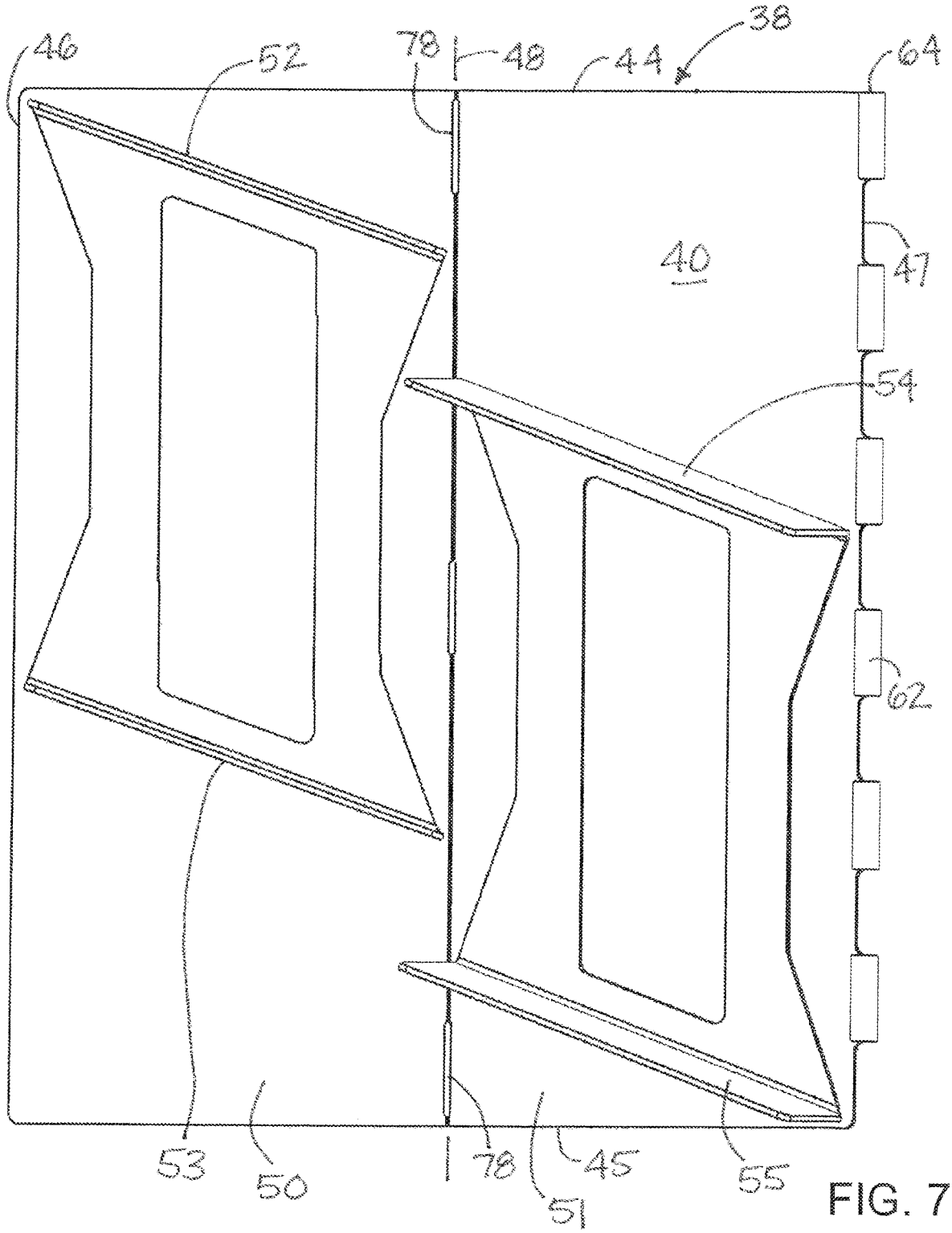
FIG. 7 is a schematic front view of an illustrative embodiment of a guide panel of the shield assembly.
Figure 8:
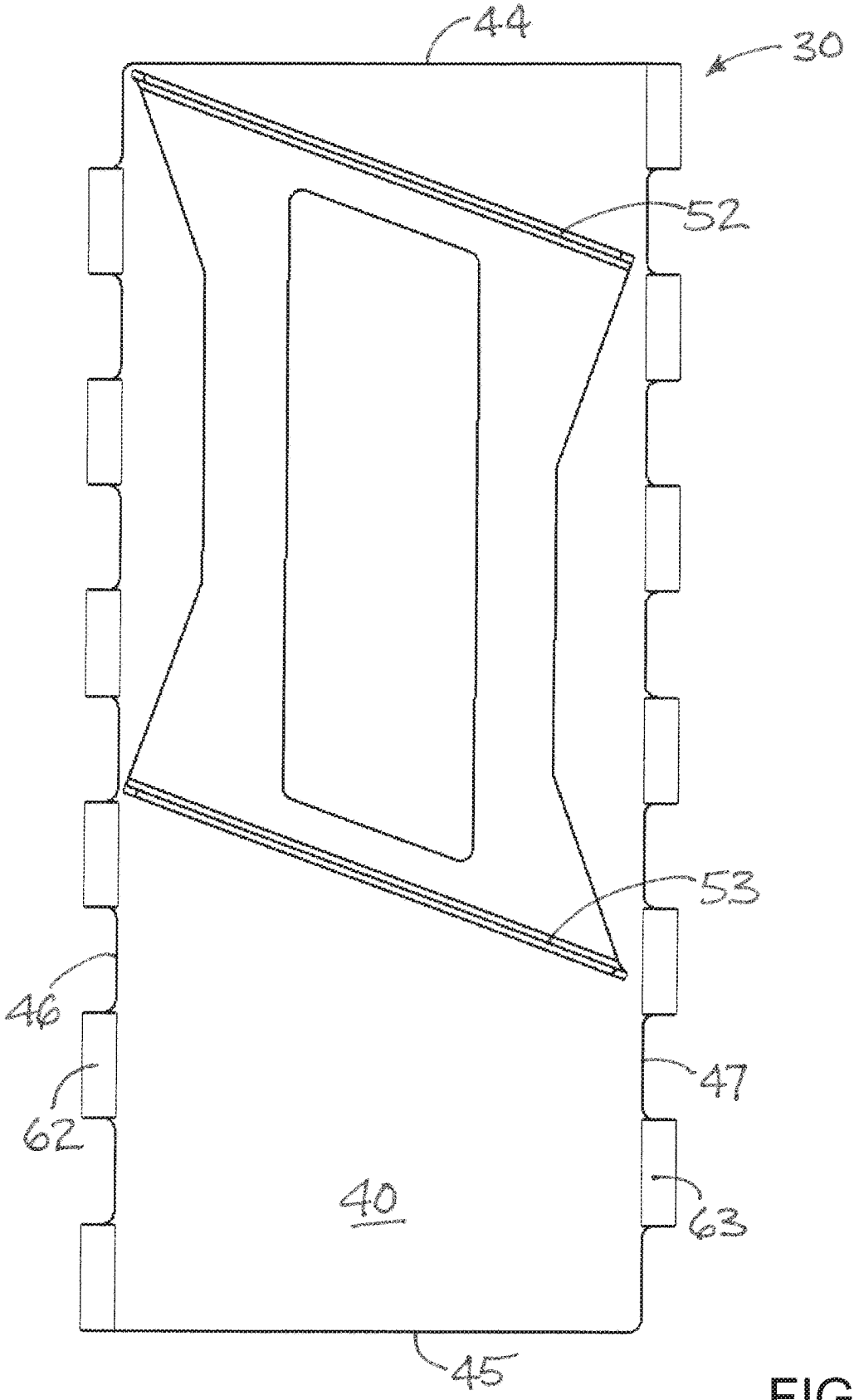
FIG. 8 is a schematic front view of another illustrative embodiment of a guide panel of the shield assembly.
Figure 9:
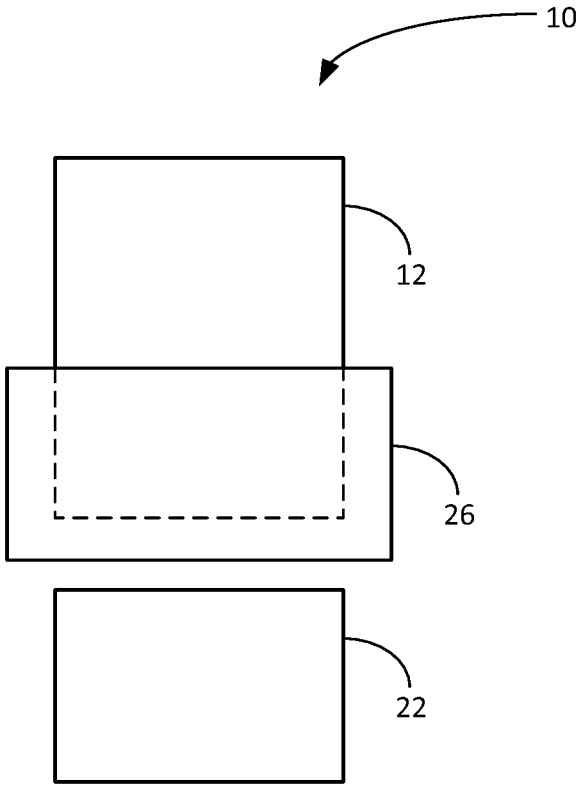
FIG. 9 is a schematic diagram of the system, according to an illustrative embodiment.

The linking structure thus provides a convenient means for adjusting the circumferential length of the shield assembly to accommodate containers of different circumferential sizes, and may permit the application of a degree of tension to the loop 28 to help hold the shield assembly in position with respect to the container. Optionally, larger adjustments of the circumferential length of the shield assembly may be accomplished by adding or removing guide panels from the array, and utilizing guide panels of different widths, such as is illustrated in FIGS. 7 and 8 of the drawings.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A shield assembly forming a loop positionable about a container to guide heated gases from a heat source along a peripheral wall of the container, the shield assembly comprising:

a plurality of guide panels collectively in an array of connected guide panels forming at least a portion of the loop, the guide panels being pivotally connected to adjacent guide panels to pivot with respect to each other, the guide panels being pivotable with respect to each other about a pivot axis, each of the guide panels comprising:

a base plate having an inner surface for orienting toward the container and an outer surface for orienting away from the container, the base plate having an upper edge and a lower edge with the inner surface extending from the lower edge to the upper edge;

at least one vane extending inwardly from the base plate to a free end of the vane positionable adjacent to the peripheral wall of the container, the at least one vane being positioned at a medial location between the upper and lower edges of the base plate such that a portion of the inner surface is located between the at least one vane and the upper edge and a portion of the inner surface is located between the at least one vane and the lower edge, the vane being positioned at an oblique angle to the pivot axis; and a linking structure configured to link endmost guide panels of the array of connected guide panels.

2. The assembly of claim 1 wherein the linking structure is configured to apply a degree of tension to the loop to facilitate holding the shield assembly in position on the container.

3. The assembly of claim 1 wherein a position of the at least one vane on the inner surface of the base plate varies between adjacent guide panels of the loop such that a distance between the at least one vane and the upper edge of the base plate of a first said guide panel is different than a distance between the at least one vane and the upper edge of the base plate of a second guide panel located adjacent to the first guide panel in the loop.

4. The assembly of claim 1 wherein the linking structure includes at least one link spanning between the endmost guide panels of the array of guide panels, the link having opposite end portions each engaging one of the endmost guide panels.

5. The assembly of claim 1 wherein the endmost guide panels define a gap therebetween and the linking structure extends across the gap; and wherein the linking structure further includes a length adjustment element configured to adjust an effective length of the at least one link to adjust a magnitude of the gap between the endmost guide panels engaged by the at least one link.

6. The assembly of claim 5 wherein each of the links includes two link portions with each of the link portions having one of the end portions; and wherein the length adjustment element engages each of the link portions of a said link at an adjustable location on the link portion to adjust the effective length of the link.

7. The assembly of claim 4 wherein each of the end portions of the link are formed into a hook, and each of the endmost guide panels having a hook aperture engaged by one of the hooks.

8. The assembly of claim 4 wherein the at least one link comprising a pair of links spaced from each other and each engaging each of the endmost guide panels.

9. The assembly of claim 1 wherein the array of connected guide panels forms a substantially continuous perimeter wall.

10. The assembly of claim 9 wherein the base plates of adjacent guide panels of the array form the perimeter wall.

11. The assembly of claim 1 additionally comprising a hinge structure connecting adjacent guide panels together in a pivotal manner.

12. The assembly of claim 11 wherein the hinge structure includes:

hinge tabs positioned on the adjacent guide panels in the array in an alternating manner, each of the hinge tabs forming a pin passage extending along the pivot axis; and a hinge pin passing through the pin passages of the hinge tabs of the adjacent guide panels.

13. The assembly of claim 1 wherein the base plate has an upper edge and a lower edge and opposite side edges, the base plate having a base axis extending substantially parallel to the side edges, the base axis dividing the base plate into two plate portions of the base plate, the inner surfaces of the two plate portions of the base plate being oriented in planes oblique to each other such that the inner surfaces of the plate portions form a convex collective surface.

14. The assembly of claim 13 wherein the at least one vane comprises a pair of vanes, the pair of vanes being located on the inner surface of a first one of the plate portions, a second pair of vanes being located on the inner surface of a second one of the plate portions.

15. A system comprising:

a container having a bottom wall and a peripheral wall extending upwardly from the bottom wall to an upper opening;

a heat source positioned below the container; and a shield assembly forming a loop positioned about the container to guide heated gases from the heat source along the peripheral wall of the container, the shield assembly comprising:

a plurality of guide panels collectively in an array of connected guide panels forming at least a portion of the loop, the guide panels being pivotally connected to adjacent guide panels to pivot with respect to each other, the guide panels being pivotable with respect to each other about a pivot axis, each of the guide panels comprising:

a base plate having an inner surface for orienting toward the container and an outer surface for orienting away from the container, the base plate having an upper edge and a lower edge with the inner surface extending from the lower edge to the upper edge;

at least one vane extending inwardly from the base plate to a free end of the vane positionable adjacent to the peripheral wall of the container, the at least one vane being positioned at a medial location between the upper and lower edges of the base plate such that a portion of the inner surface is located between the at least one vane and the upper edge and a portion of the inner surface is located between the at least one vane and the lower edge, the vane being positioned at an oblique angle to the pivot axis; and a linking structure configured to link endmost guide panels of the array of connected guide panels.

* * * * *